US006173721B1

(12) United States Patent
Mery

(10) Patent No.: US 6,173,721 B1
(45) Date of Patent: Jan. 16, 2001

(54) PULLEY SYSTEM FOR PATIO UMBRELLA

(75) Inventor: Jhoni Mery, Jakarta Utara (ID)

(73) Assignee: Seville Classics, Inc., Los Angeles, CA (US)

( * ) Notice: Under 35 U.S.C. 154(b), the term of this patent shall be extended for 0 days.

(21) Appl. No.: 09/394,542

(22) Filed: Sep. 10, 1999

(51) Int. Cl.[7] ..... A45B 25/14
(52) U.S. Cl. ..... 135/16; 135/20.3; 135/27
(58) Field of Search ..... 135/16, 20.3, 27, 135/38, 39, 41

(56) References Cited

U.S. PATENT DOCUMENTS 2,745,421 * 5/1956 Russell ..... 135/20.3 X
6,016,822 * 1/2000 Lin et al. ..... 135/20.3 X

* cited by examiner

*Primary Examiner*—Daniel P. Stodola
*Assistant Examiner*—Hugh B. Thompson
(74) *Attorney, Agent, or Firm*—Raymond Sun

(57) ABSTRACT

A patio umbrella has a pole that has an opening extending therethrough. The patio umbrella has a plurality of ribs for supporting and umbrella covering, and a runner adapted to slide along the pole and coupled to the ribs. The patio umbrella further includes a pulley system that has a first pulley member secured to a first side of the pole, a second pulley member coupled to the runner on the first side of the pole, a wheel positioned inside the opening of the pole, and a pulley rope. The pulley rope has a first end secured to the second pulley member and passes through the first and second pulley members, and then through the wheel inside the opening of the pole, to a free end that is positioned on a side of the pole that is opposite to the first side.

6 Claims, 4 Drawing Sheets

PULLEY SYSTEM FOR PATIO UMBRELLA

BACKGROUND OF THE INVENTION

1. Field of the Invention

The present invention relates to outdoor and patio umbrellas, and in particular, to an improved pulley system for use with outdoor and patio umbrellas.

2. Description of the Prior Art

Outdoor and patio umbrellas (hereinafter referred to collectively as patio umbrellas) have become increasingly popular in recent years as people have found new and useful applications for them. For example, patio umbrellas have traditionally been used at patios and backyards of homes to provide shade from sunlight. Patio umbrellas have also been used extensively at swimming pools and other play or recreation facilities to provide shade. Recently, hotels (and in particular, resorts) and restaurants have been major purchasers of these umbrellas.

In some locales, such as in tropical countries and resort areas where warm weather prevails for most of the year, these patio umbrellas will usually see extended usage. In addition, patio umbrellas are typically very heavy, large in size and bulky, thereby making them somewhat inconvenient to store and transport. However, patio umbrellas must carry sufficient weight and sturdiness to provide the necessary stability, otherwise they would not be appropriate for outdoor use.

For the above reasons, it is important that patio umbrellas be easy to open (i.e., deploy) and close (i.e., for storage). An important part of every patio umbrella is the pulley system. FIG. 1 illustrates a conventional pulley system that is commonly used for opening and closing patio umbrellas. FIG. 1 illustrates a section of the pole 10 of the umbrella along which a lower hub or runner 12 can be slid vertically upwardly or downwardly. A first pulley member 14 is secured to the pole 10 and a second pulley member 16 is secured to the runner 12. A pulley rope 18 has a first end 20 that is tied or knotted to a shaft 22 at a top end of the second pulley member 16. The rope 18 is then extended upwardly and passed through a lower wheel 24 of the first pulley member 14, and is then pulled back down towards the second pulley member 16 and passed through a wheel 26. The rope 18 is again extended upwardly and passed through an upper wheel 28 of the first pulley member 14, and is then pulled back down towards the bottom of the pole 10, where the user can manipulate the free end 30 of the rope 18.

As shown in FIG. 1, all the elements of the pulley system are provided on one side of the pole 10. Therefore, one drawback associated with the conventional pulley system of FIG. 1 is that all the forces operating on the pulley system are exerted on the same side of the pole 10. For example, to open the umbrella, the user must pull down on the free end 30 of the rope 18 in the direction of the arrow X, which decreases the length of the rope 18 between the first and second pulley members 14 and 16. This in turn causes the second pulley member 16 to be lifted vertically along the pole 10 towards the first pulley member 14 in the direction of arrow Y, thereby causing the ribs of the umbrella to be opened. As shown in FIG. 1, the forces indicated by arrows X and Y are on the same side of the pole 10 in that all the rotating wheels are inside pulley members 14 and 16 that are secured to the same side of the pole 10. Therefore, pulling down on the free end 30 may cause the umbrella to tilt to one side when the pulley rope 18 is being pulled down to open the umbrella. As a result, it can be difficult to pull and release the rope 18 to open and close, respectively, the umbrella. This is especially troublesome if the umbrella is heavy.

Thus, there remains a need to provide a patio umbrella that overcomes the drawbacks set forth above, and which provides a pulley system that provides better balance and weight distribution in use thereof in opening and closing the umbrella.

SUMMARY OF THE DISCLOSURE

It is an object of the present invention to provide a patio umbrella that is convenient and easy to open and close.

It is another object of the present invention to provide a pulley system for a patio umbrella that provides better balance and weight distribution in use thereof.

The objectives of the present invention are accomplished by providing a patio umbrella having a pole that has an opening extending therethrough. The patio umbrella has a plurality of ribs for supporting and umbrella covering, and a runner adapted to slide along the pole and coupled to the ribs. The patio umbrella further includes a pulley system that has a first pulley member secured to a first side of the pole, a second pulley member coupled to the runner on the first side of the pole, a wheel positioned inside the opening of the pole, and a pulley rope. The pulley rope has a first end secured to the second pulley member and passes through the first and second pulley members, and then through the wheel inside the opening of the pole, to a free end that is positioned on a side of the pole that is opposite to the first side.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail. The present invention provides a novel pulley system that provides better weight balance to the pulley system during the opening and closing actions of a patio umbrella. This is accomplished by providing a wheel inside the pole of the umbrella, and passing the pulley rope therethrough so that the pulley action, and the forces associated therewith, extend along both sides of the pole.

Figure 1:
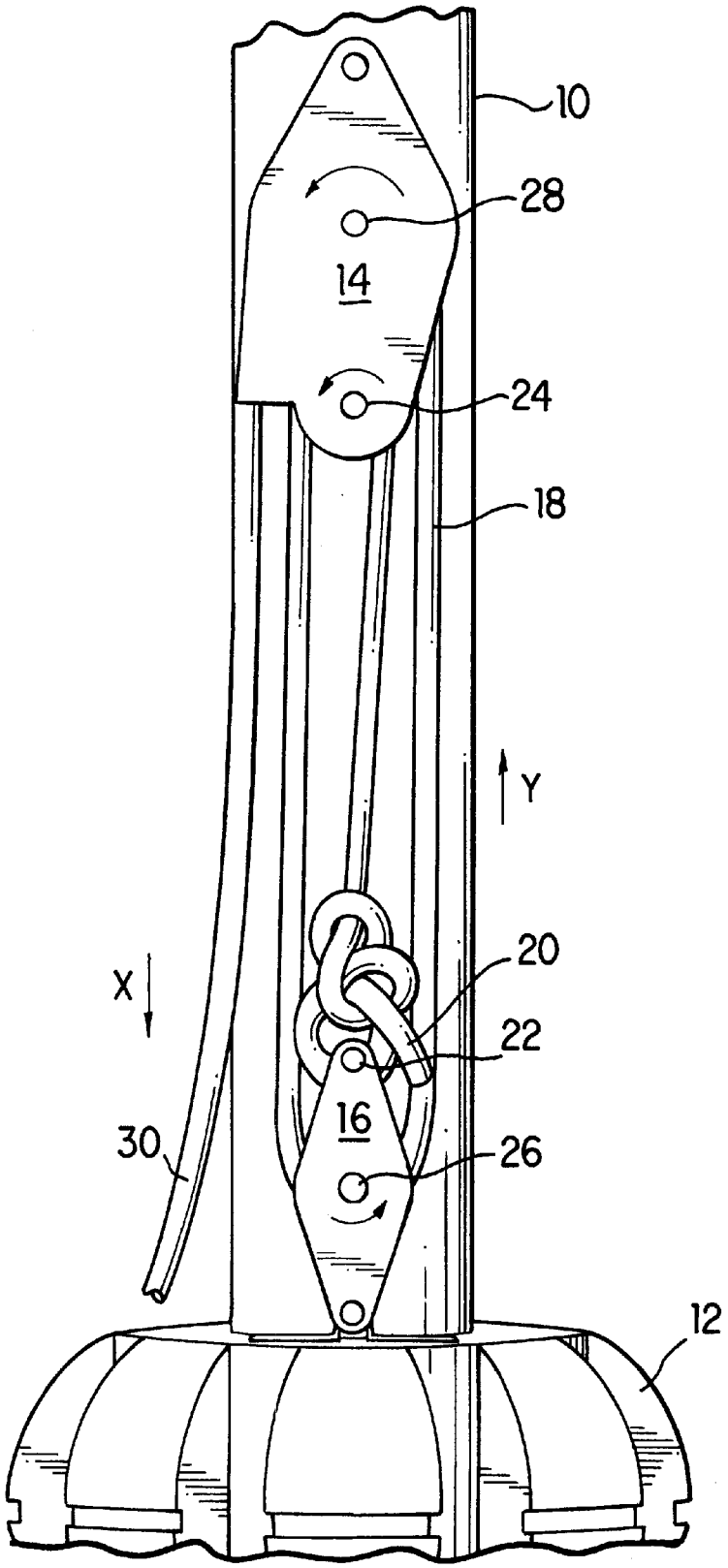
FIG. 1 (PRIOR ART)
FIG. 1 is a sectional side view of a conventional pulley system that can be used with a patio umbrella.
Figure 2:
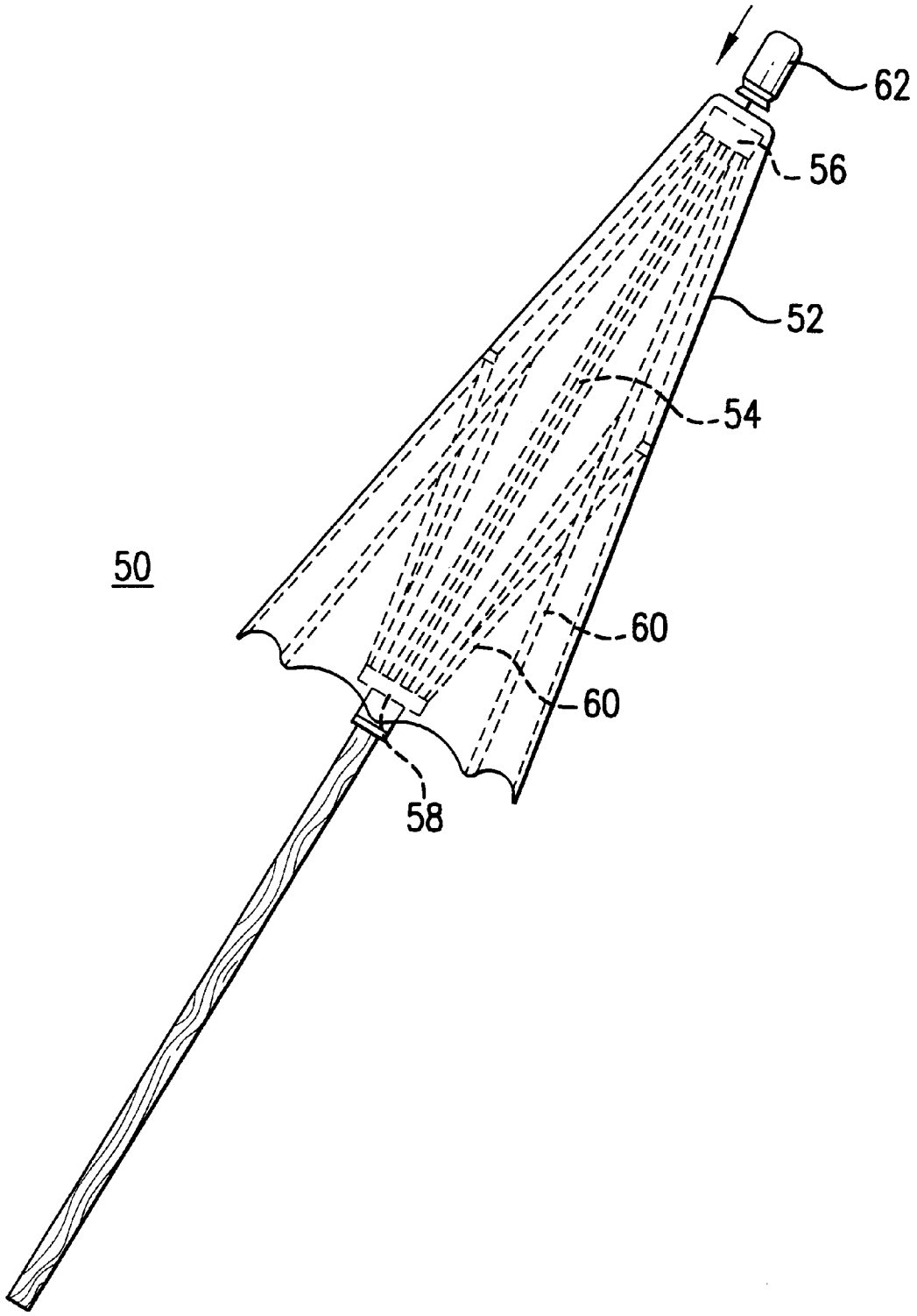
FIG. 2 is a perspective view of a patio umbrella according to the present invention.

FIG. 2 illustrates a patio umbrella 50 according to the present invention. The umbrella So is shown in a closed configuration, with the umbrella covering 52 folded down along the pole 54. A fixed upper hub 56 (shown in phantom) is secured to the top end of the pole 54, adjacent the finial 62. A lower hub or runner 58 (shown in phantom) is adapted to slide along the vertical length of the pole 54. A plurality of ribs 60 (shown in phantom) extend from the hubs 56 and 58, and operate to support the covering 52. The construction and operation of the pole 54, the hubs 56 and 58, the ribs 60 and the covering 52 can be the same as those in conventional patio umbrellas, which are well-known in the art and will not be described in greater detail herein.

The pulley system according to the present invention will be described with reference to FIGS. 3 and 4. The pole 54 has a horizontal opening or bore 66 provided adjacent the upper hub 56, and extending through the pole 54. A shaft 68 extends 5 transversely across the opening 66, and a first wheel 70 is supported for rotation on the shaft 68. The wheel 70 can be the same as any pulley wheel, except that it is preferably larger in size. As a non-limiting example, the wheel 70 can have a diameter of about 2.125 inches.

In addition, a first pulley member 72 has a top shaft 74 that allows the first pulley member 72 to be suspended from a hook 76 extending downwardly from the upper hub 56. The first pulley member 72 also has a lower shaft 78 on which a second wheel 80 (shown in phantom in FIG. 4) can be supported for rotation. The first pulley member 72 has opposing plates 71 and 73 between which the shafts 74 and 78 extend.

Similarly, a second pulley member 82 has a bottom shaft 84 that allows a hook 86 extending upwardly from the lower hub 58 to be supported thereon. The second pulley member 82 also has a center shaft 88 on which a third wheel 90 (shown in phantom in FIG. 4) can be supported for rotation. The second pulley member 82 further includes a top shaft 92 that allows an end of a pulley rope 94 to be tied or knotted thereto, as explained below. The second pulley member 82 has opposing plates 81 and 83 between which the shafts 84, 88 and 92 extend.

The second and third wheels 80 and 90 can be the same as wheels used for similar pulley systems in conventional patio umbrellas, but are preferably smaller than the first wheel 70. As a non-limiting example, each wheel 80 and 90 can have a diameter of about one inch.

The pulley system of the present invention provides a pulley rope 94 having a first or knotted end 100 that is tied or knotted about the top shaft 92 of the second pulley member 82. From the knotted end 100, the pulley rope 94 extends upwardly towards the first pulley member 72 and passes through the second wheel 80 to extend downwardly towards the second pulley member 82, where the rope 94 passes through the third wheel 90 and back upwardly towards the opening 66. The rope 94 is then passed through the first wheel 70 so that the rope 94 essentially passes through the pole 54 to the other side of the pole 54 where the free end 102 of the rope 94 extends. This is most clearly illustrated in FIG. 3, where the pulley members 72 and 82 are positioned on a first side (see arrow A) of the pole 54, while the free end 102 of the rope 94 extends along a second opposite side (see arrow B) of the pole 54.

In operation, the user opens the patio umbrella 50 by pulling vertically downwardly in the direction of arrow C on the free end 102 of the pulley rope 94. This pulls the rope 94 over the first wheel 70 (see arrow D), decreasing the length of the rope 94 between the first and second pulley members 72 and 82. This in turn causes the second pulley member 82 to be lifted vertically along the pole 54 towards the first pulley member 72 in the direction of arrow E, thereby causing the ribs 60 to be opened as shown in FIGS. 3 and 4. The opened orientation of the umbrella 50 can be maintained by tying the free end 102 to a hook or other mechanism (not shown), as is well-known in the art.

To close the patio umbrella 50, the user merely releases the free end 102 of the rope 94. The weight of the lower hub 58 and the force of gravity will pull the lower hub 58 downwardly along the pole 54 in the direction opposite to that of arrow E, increasing the length of the rope 94 between the pulley members 72 and 82, and causing the free end 102 to be pulled upwardly in the direction opposite to that of arrow C. When the lower hub 58 slides downwardly, the ribs 60 will be drawn towards the pole 54 to close the umbrella 50.

Figure 3:
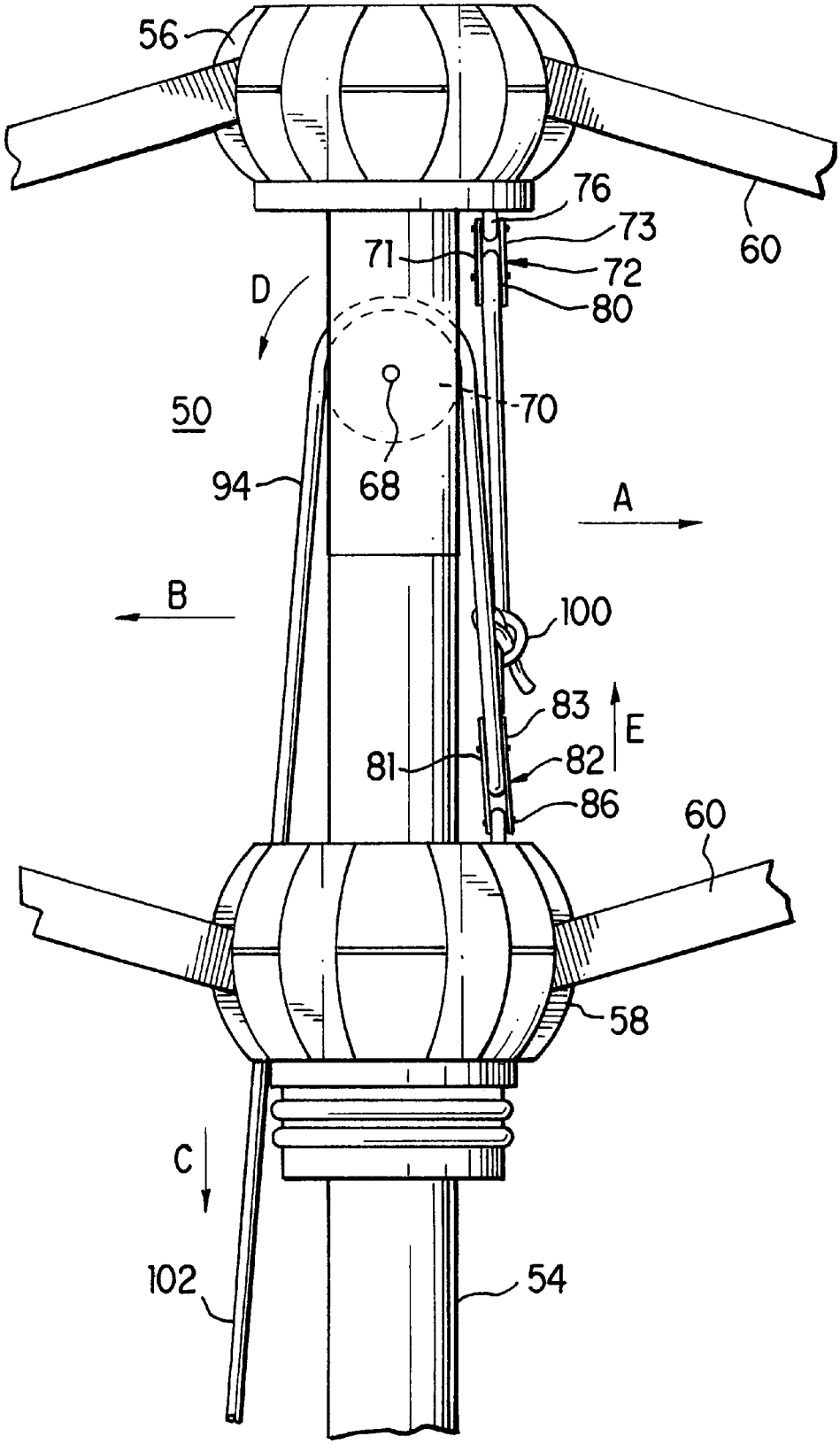
FIG. 3 is an expanded front view of a section of the patio umbrella of FIG. 2 illustrating the pulley system according to an embodiment of the present invention.
Figure 4:
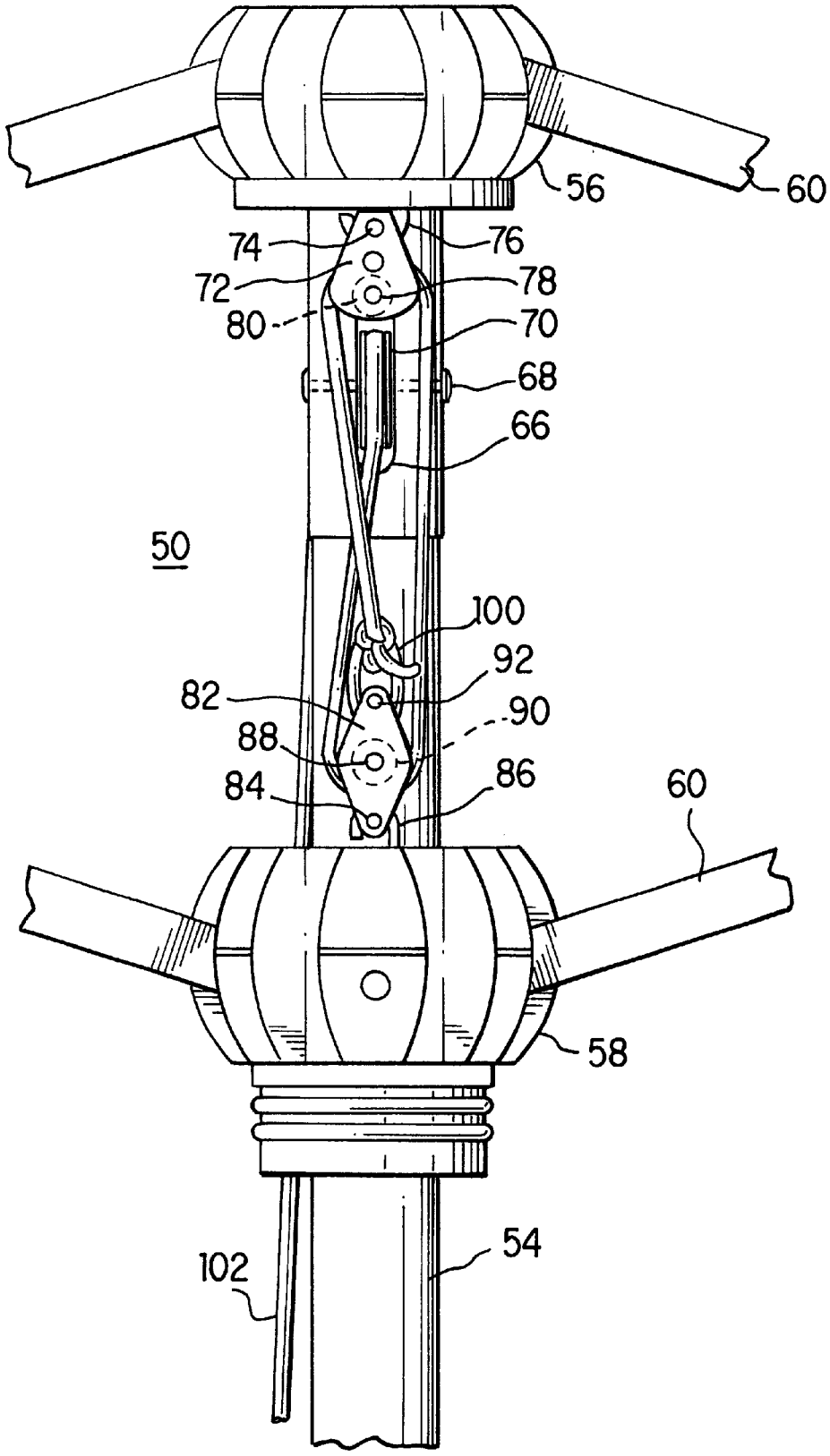
FIG. 4 is an expanded side view of a section of the patio umbrella of FIG. 2 illustrating the pulley system according to an embodiment of the present invention.

The arrows C and E in FIG. 3 illustrate the directions of the forces that are normally applied when the pulley system of the present invention is deployed to open the umbrella 50. As shown in FIG. 3, the forces C and E are on opposing sides of the pole 54. Therefore, when the user pulls down on the free end 102 of the rope 94 to exert the force C, the forces C and E are more balanced since they are on opposite sides of the pole 54, so that the umbrella 50 does not tilt to either side. In this regard, the provision of the first wheel 70 inside the pole 54 transitions or distributes some of the forces away from the first and second pulley members 72 and 82, so as to render the pulling and release of the free end 102 to be smoother and more stable.

In addition, by providing the first wheel 70 with a larger size that the second and third wheels 80 and 90, the pulley system is provided with higher torque to enable the rope 54 to slide more easily throughout.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A patio umbrella comprising:

a pole having a first side, and an opening extending therethrough;

an umbrella covering;

a plurality of ribs for supporting the umbrella covering;

a runner adapted to slide along the Vole and coupled to the ribs; and a pulley system, the pulley system co-prising:

a first pulley member secured to the first side of the pole and exterior to the pole;

a second pulley member coupled on the first side of the pole to the runner, the first and second pulley members being generally vertically aligned;

a wheel positioned inside the opening of the pole; and a pulley rope having a first end secured to the second pulley member, the pulley rope passing through the first and second pulley members, and through the wheel inside the opening of the pole, to a free end that is positioned on a side of the pole that is opposite to The first side.

2. The umbrella of claim 1, wherein the pole has a top end, and the first pulley member is secured adjacent the top end.

3. The umbrella of claim 2, further including an upper hub secured adjacent the top end, and the first pulley member is coupled to the upper hub.

4. The umbrella of claim 1, wherein each pulley member has a wheel about which the pulley rope passes, with the wheel positioned inside the opening of the pole having a larger diameter than the wheels in the pulley members.

5. The umbrella of claim 1, wherein the first end of the pulley rope is knotted or tied to an upper portion of the second pulley member.

6. The umbrella of claim 5, wherein the first and second pulley members each has a wheel, and wherein the free end of the pulley rope extends from the second pulley member around the wheel of the first pulley member, then back around the wheel of the second pulley member and then about the wheel inside the opening of the pole.

* * * * *